US005209210A

United States Patent [19]

Ikeda et al.

[11] Patent Number: 5,209,210

[45] Date of Patent: May 11, 1993

[54] EVAPORATIVE EMISSION CONTROL SYSTEM

[75] Inventors: Satoru Ikeda, Toyoake; Kazumi Haruta, Obu; Kenji Koeda, Nagoya, all of Japan

[73] Assignee: Aisan Kogyo Kabushiki Kaisha, Ohbu, Japan

[21] Appl. No.: 722,214

[22] Filed: Jun. 27, 1991

[30] Foreign Application Priority Data

Aug. 10, 1990 [JP] Japan ..... 2-84706[U]

[51] Int. Cl.[5] ..... F02M 33/02

[52] U.S. Cl. ..... 123/520; 123/516

[58] Field of Search ..... 123/516, 518, 519, 520, 123/521

[56] References Cited

U.S. PATENT DOCUMENTS

| | | | |
|---|---|---|---|
| 3,779,224 | 12/1973 | Tagawa | 123/518 |
| 4,700,750 | 10/1987 | Cook | 123/518 |
| 4,862,856 | 9/1989 | Yokoe | 123/520 |
| 4,986,246 | 1/1991 | Kessler de Vivie | 123/520 |
| 5,036,823 | 8/1991 | Mackinnon | 123/520 |

FOREIGN PATENT DOCUMENTS

| | | | |
|---|---|---|---|
| 0301944 | 2/1989 | European Pat. Off. | 123/518 |
| 0110853 | 7/1983 | Japan | 123/519 |
| 0174150 | 10/1983 | Japan | 123/519 |
| 0029761 | 2/1984 | Japan | 123/520 |
| 59-40561 | 3/1984 | Japan . | |
| 0007962 | 1/1987 | Japan | 123/519 |
| 62-38467 | 3/1987 | Japan . | |

*Primary Examiner*—Carl S. Miller

*Attorney, Agent, or Firm*—Cushman, Darby & Cushman

[57] ABSTRACT

An apparatus is provided for preventing emission of fuel vapor generated in a fuel tank during fuel supply, including a fuel supplying canister for absorbing the fuel vapor and desorbing the absorbed fuel vapor by an intake air flow in the operation of an internal combustion engine. The fuel supplying canister is provided, on one side of its vessel, with a tank port connected to the fuel tank and a purge port connected to an air intake passage of the internal combustion engine, and also provided with an atmospheric air port for introducing air on the other side thereof. The atmospheric air port includes a switching device for controlling the cross-sectional area of an atmospheric air passage in a manner that the switching device is fully opened during fuel supply, and that at other times a predetermined restriction hole is defined therein. Owing to this structure, the intake pipe negative pressure in the internal combustion engine can be efficiently applied into the canister without degrading the fuel supplying efficiency, so that the desorption of the fuel vapor absorbed in the activated carbon of the canister during fuel supply is much improved. Moreover, the residual fuel vapor in the activated carbon becomes less, and consequently, the lowering or degradation of absorption efficiency of the activated carbon because of aged deterioration can be prevented.

4 Claims, 4 Drawing Sheets

EVAPORATIVE EMISSION CONTROL SYSTEM

BACKGROUND OF THE INVENTION

1. Industrial Field of the Invention

The present invention relates to an improvement for preventing the emission of fuel vapor generated during fuel supply.

2. Description of the Prior Art

Japanese Utility Model Unexamined Publication No. 59-40561 discloses a proposal for improving the absorption and desorption efficiency of fuel vapor by defining a restriction hole in an atmospheric air port of a canister.

Further, Japanese Utility Model Unexamined Publication No. 62-38467 discloses an apparatus for preventing the emission of fuel vapor in which fuel vapor generated during fuel supply is to be absorbed in a canister and the absorbed fuel vapor is to be desorbed by means of an intake air caused by an engine operation. In this apparatus, a restriction hole is not defined in an atmospheric air port of the canister.

SUMMARY OF THE INVENTION

Of the above-described conventional arts, it has been considered to improve the absorption and desorption efficiency of the canister of the latter apparatus for preventing the emission of fuel vapor. In order to achieve this purpose, by applying a canister according to the former in place of the latter canister it seems to yield a good result. However, the canister according to the former is provided with the restriction hole in the atmospheric air port, so that the internal pressure of a fuel tank rises during fuel supply. Therefore, it causes a problem in that an automatic stop device of a fuel supplying nozzle is operated because of the rising pressure, thereby preventing the fuel supply, and also a problem in that the fuel in the fuel tank is overflown from a filler hose port. Hence, such a method for improvement can not be employed.

Therefore, one object of the present invention is to provide an apparatus for preventing the emission of fuel vapor during fuel supply which has been improved in the absorption and desorption efficiency of a canister without causing the above-described problems.

In order to achieve the above-described object, the apparatus for preventing the emission of fuel vapor according to the present invention has a structure comprising a fuel supplying canister for absorbing fuel vapor generated in a fuel tank during fuel supply and desorbing the absorbed fuel vapor by means of an intake air flow caused by the operation of an internal combustion engine, and the fuel supplying canister is provided, on one side of its vessel, with a tank port connected to the fuel tank and a purge port connected to an air intake passage of the internal combustion engine, and also provided with an atmospheric air port for introducing air on the other side thereof. Further, the atmospheric air port includes switching means for controlling the cross-sectional area of an atmospheric air passage in such a manner that the switching means are fully opened during fuel supply, and that at other times a predetermined restriction hole is defined in the atmospheric air passage.

As to the operation of this apparatus, the atmospheric air port of the fuel supplying canister is fully opened during fuel supply. Therefore, the internal pressure in the fuel tank which has risen and the fuel vapor generated in the fuel tank flows through the passage with small resistance into the fuel supplying canister where the fuel vapor is absorbed. At times other than fuel supply, a predetermined restriction hole is defined in the atmospheric air port of the fuel supplying canister, so that the intake pipe negative pressure caused by the operation of the internal combustion engine is applied to the fuel supplying canister to thereby carry out the desorption of the fuel vapor effectively.

BRIEF DESCRIPTION OF THE DRAWINGS

FIG. 1A shows an energized condition; and

FIG. 1B shows a non-energized condition.

DETAILED DESCRIPTION OF THE PREFERRED EMBODIMENTS

Figure 2:
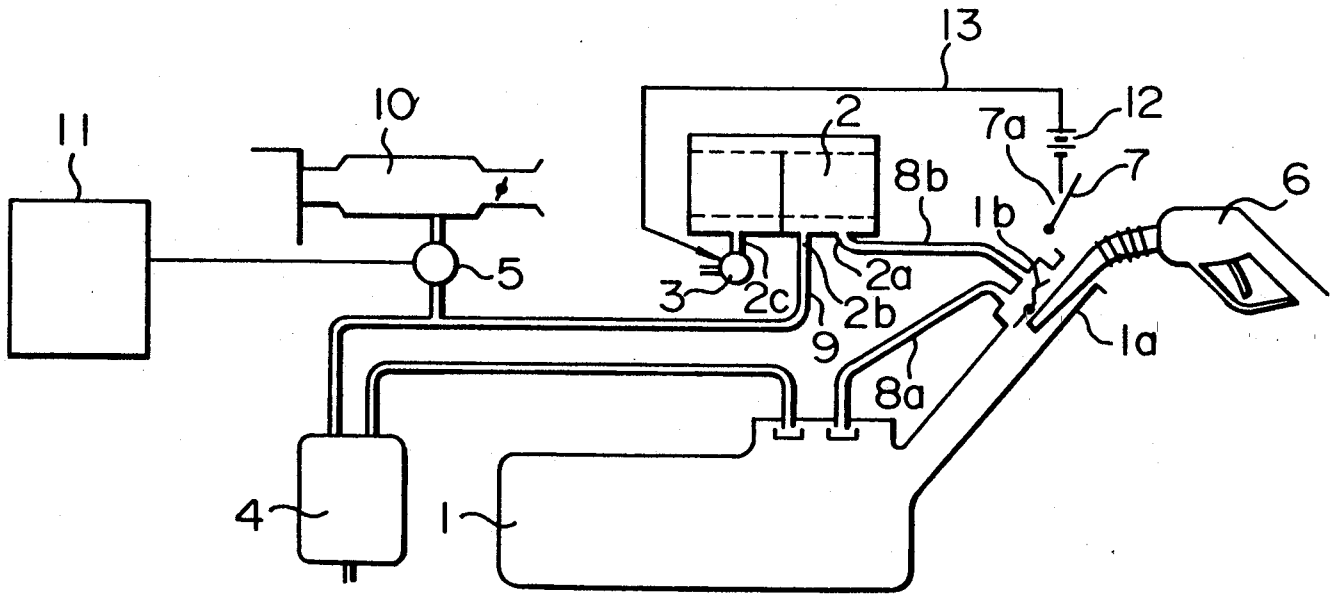
FIG. 2 is a schematic view showing an overall structure of one embodiment of an apparatus according to the invention.

In FIG. 2, reference numeral 1 is a fuel tank, 2 is a fuel supplying canister, 3 is a switching valve, 4 is an evaporation canister, 5 is a purge control valve, 6 is a fuel supplying nozzle, 7 is a filler cap, 8*a* and 8*b* are vapor passages, 9 is a purge passage, 10 is an intake air passage, 11 is a control circuit, 12 is a battery, and 13 is a circuit for supplying exciting current to the coil of the switching valve 3.

Figure 3:
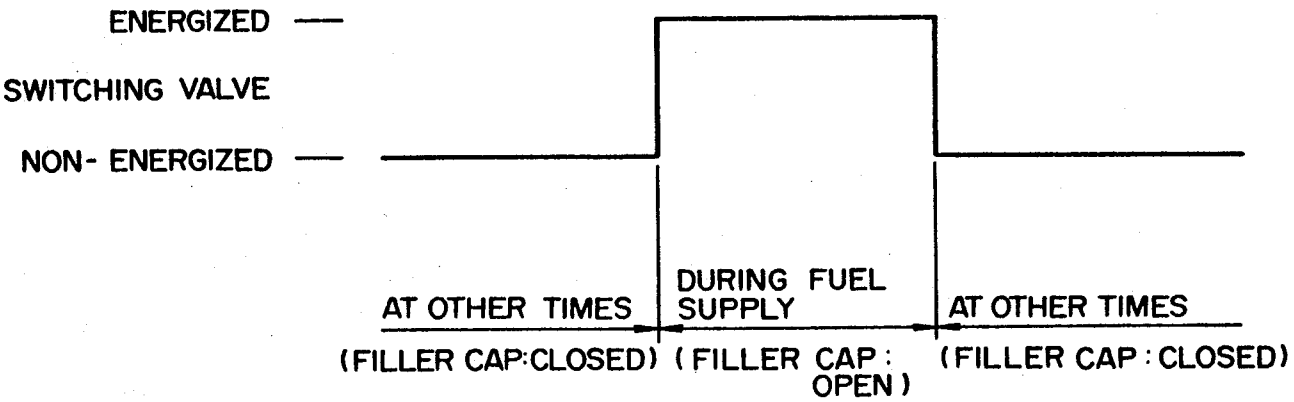
FIG. 3 is a diagram showing an operation of a switching valve.
Figure 4:
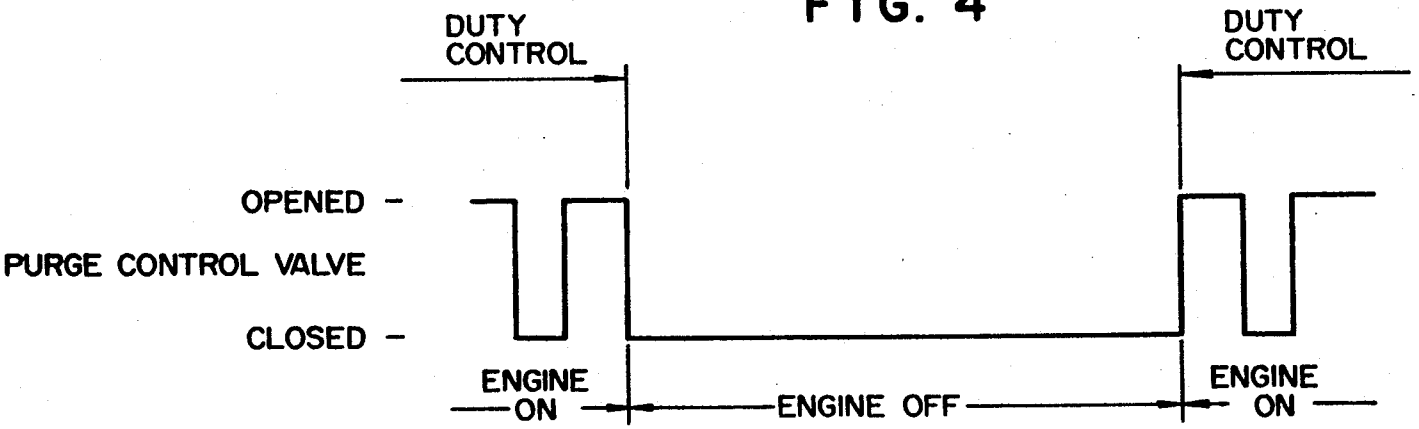
FIG. 4 is a diagram showing an operation of a purge control valve.

The fuel supplying canister 2 is provided with a tank port 2*a* and a purge port 2*b* on one side thereof and an atmospheric air port 2*c* on the other side thereof. Activated carbon is filled in the vessel of the fuel supplying canister 2. The tank port 2*a* is connected to a filler hose port la of the fuel tank 1 through the vapor passage 8*b*, while the upper portion of the fuel tank 1 is connected to the filler hose port 1*a* through the vapor passage 8*a*. The filler hose port 1*a* is provided with a closing valve 1*b*, which is operated when it is pushed by the distal end of the fuel supplying nozzle 6 inserted into the filler hose port 1*a*, to thereby open one end of the vapor passage 8*b* (the right end in the figure) where it is opened toward the filler hose port 1*a*. Then, the closing valve 1*b* is adapted to close the above-described opening end of the vapor passage 8*b* when the fuel supplying nozzle 6 is extracted from the filler hose port 1*a*. The filler cap 7 includes a switch 7*a* which is operated in response to the opening and closing movement of the filler cap 7. When the filler cap 7 is opened during fuel supply, the switch 7*a* is closed to supply exciting current from the battery 12 to the coil of the switching valve 3 through the circuit 13. When the filler cap 7 is closed after supplying fuel, the switch 7*a* is opened to cut off the exciting current to the coil of the switch in valve 3 (see FIG. 3). It should be noted in this embodiment that a contactless switch is used as the switch 7*a* with regard to being explosion proof. The purge port 2*b* of the canister 2 is connected to the intake air passage 10 through the passage 9 and the purge control valve 5. The purge control valve 5 is a magnetic valve operated by the control circuit 11, which has a well-known structure such that the valve is closed in the engine-off state, and that duty control is carried out according to the operating conditions of the engine during the engine-on state (see FIG. 4). That is to say, while operating the engine, the amount of evaporation of fuel is controlled by making the duty ratio smaller during idling so as to make the opening and closing period of the purge control valve 5 shorter and by making the duty ratio larger as the engine load increases so as to make the opening and closing period of the purge control valve 5 longer.

Figure 1A:
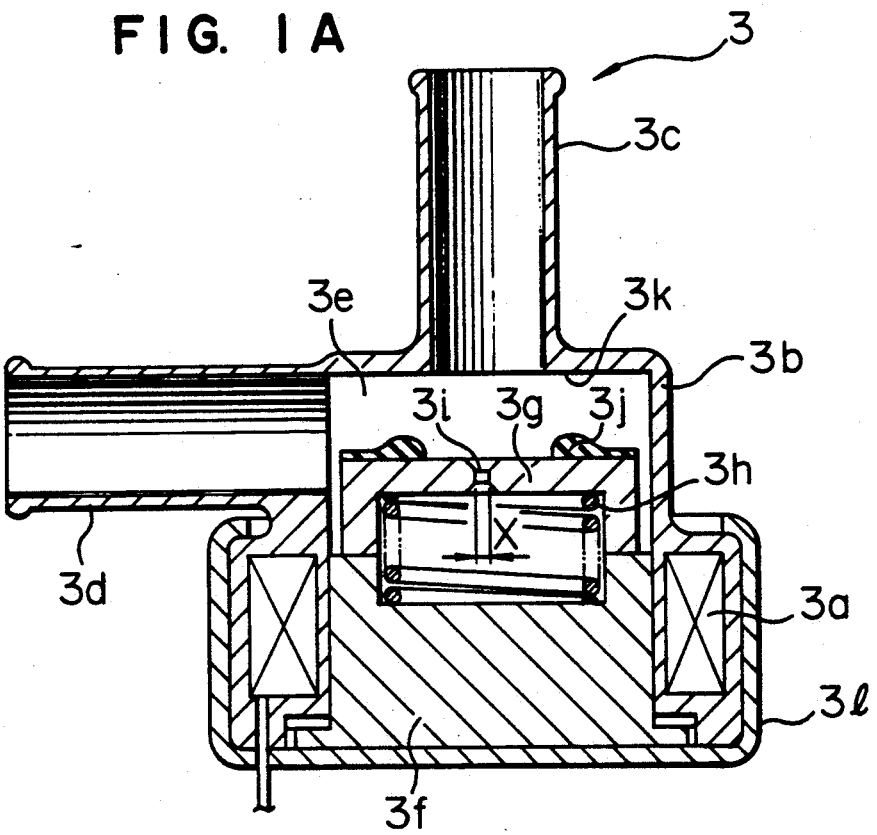
FIGS. 1A and 1B are vertical cross-sectional views showing one embodiment of switching means for controlling the cross-sectional area of the passage through which the air passes (a switching valve) according to the present invention.
Figure 1B:
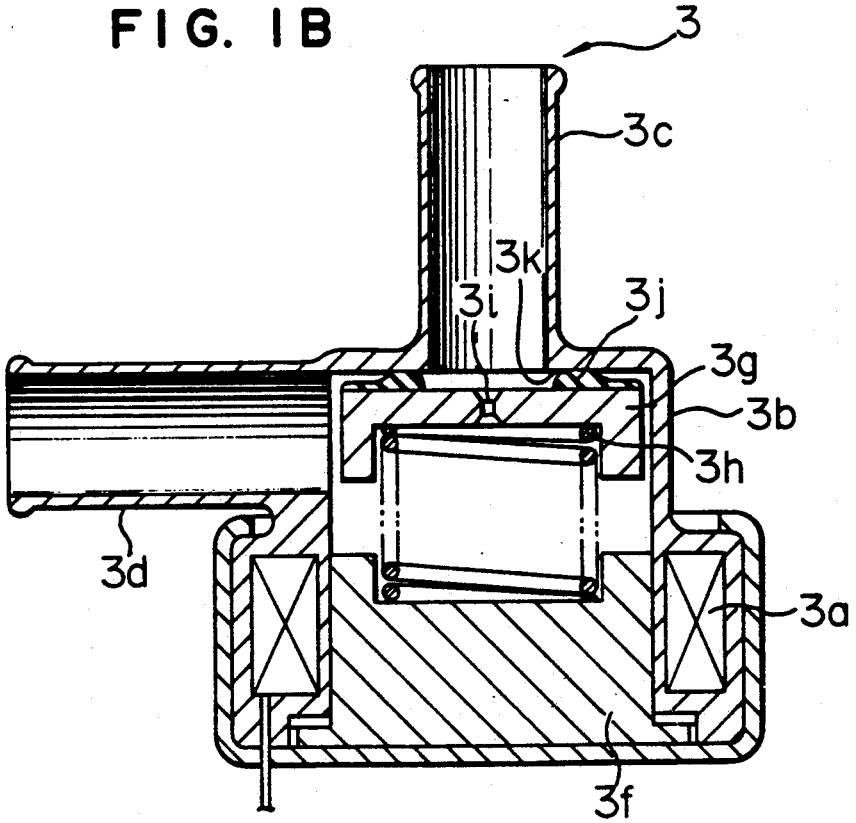

The switching valve 3 serves as switching means for controlling the cross-sectional area of an atmospheric air passage in such a manner that the valve is fully opened during fuel supply, and that at other times a predetermined restriction hole is defined in the passage to the atmospheric air port 2*c* of the fuel supplying canister 2. The switching valve (the switching means for controlling the cross-sectional area of the atmospheric air passage) 3, as shown in FIGS. 1A and 1B, comprises a non-magnetic body 3*b* in which the coil 3*a* is embedded, pipes 3*c* and 3*d* formed on the body 3*b*, a passage 3*e* communicating between the pipes 3*c* and 3*d*, an iron core 3*f* disposed inside of the coil 3*a*, a valve disk 3*g* movable upwardly and downwardly inside of the body 3*b*, a spring 3*h* which biases the valve disk 3*g* upwardly, a restriction hole 3*i* having a diameter X bored through the valve disk 3*g*, a valve rubber 3*j* attached to the upper portion of the valve disk 3*g*, a valve seat 3*k* provided on the body 3*b*, and an iron cover 3*l*. At the time of fuel supply when the exciting current is running through the coil 3*a*, the passage 3*e* is fully opened as the valve disk 3*g* is attracted to the iron core 3*f*, as shown in FIG. 1A. At other times, with the coil 3*a* being not magnetized, the valve disc 3*g* is moved upwardly by the spring 3*h*, causing the valve rubber 3*j* to be pressed against the valve seat 3*k*, so that the restriction hole 3*i* having the diameter X is defined in the passage 3*e* communicating between the pipes 3*c* and 3*d*.

In this way, the switching valve (the switching means for controlling the cross-sectional area of the atmospheric air passage) 3 is operated in response to the opening and closing movement of the filler cap 7. As for the structure of the switching valve, instead of boring a hole with the diameter X as the restriction hole 3*i* in the valve disk 3*g*, as shown in FIGS. 1A and 1B, a small passing hole can be bored through the pipe wall of the pipe 3*c* to serve as a restriction hole. The structure of a switching valve as switching means for controlling the cross-sectional area of the atmospheric air passage can be varied in addition to the above-described structures.

According to the above embodiment, during fuel supply, the filler cap 7 is opened and in turn the switch 7*a* operated in response to the movement of this filler cap is closed to supply the exciting current from the battery 12 to the coil 3*a* of the switching valve 3, thereby causing the atmospheric air port 2*c* of the switching valve 3 to be fully opened. When the fuel supply starts, the fuel vapor generated in the fuel tank 1 passes through the vapor passage 8*a*, goes on through the closing valve 1*b* which is opened by the fuel supplying nozzle 6, flows through the vapor passage 8*b*, and then enters into the fuel supplying canister 2 through the filler port 2*a* so as to be absorbed into the activated carbon. At this time, the switching valve 3 is in an open state, so that the fuel supplying nozzle 6 is not affected by higher level pressure than the predetermined pressure, thereby enabling fuel supply without any problems. Further, as well known in the art, the evaporation canister 4 is provided with a check valve and a valve of injection-valve opening pressure which is higher than that of fuel vapor at the time of fuel supply, thereby preventing the fuel vapor from flowing out. After completing fuel supply, the fuel supplying nozzle 6 is extracted to close the vapor passage 8*b* by the closing valve 1*b*. Also, by closing the filler cap 7, the switch 7*a* is opened and the switching valve 3 is turned into non-magnetized condition as shown in FIG. 1B, thus defining the predetermined restriction hole 3*i* in the passage to the atmospheric air port 2*c* of the fuel supplying canister 2. While operating the internal combustion engine, the intake pipe negative pressure generated in the intake air passage 10 passes through the purge passage 9 to be applied on the atmospheric air port 2*c* of the fuel supplying canister 2. Because the restriction hole 3*i* is defined in the passage to the atmospheric air port 2*c* of the fuel supplying canister 2, a large negative pressure can be applied in the fuel supplying canister 2, enabling efficient desorption of the fuel vapor absorbed in the activated carbon.

Figure 5:
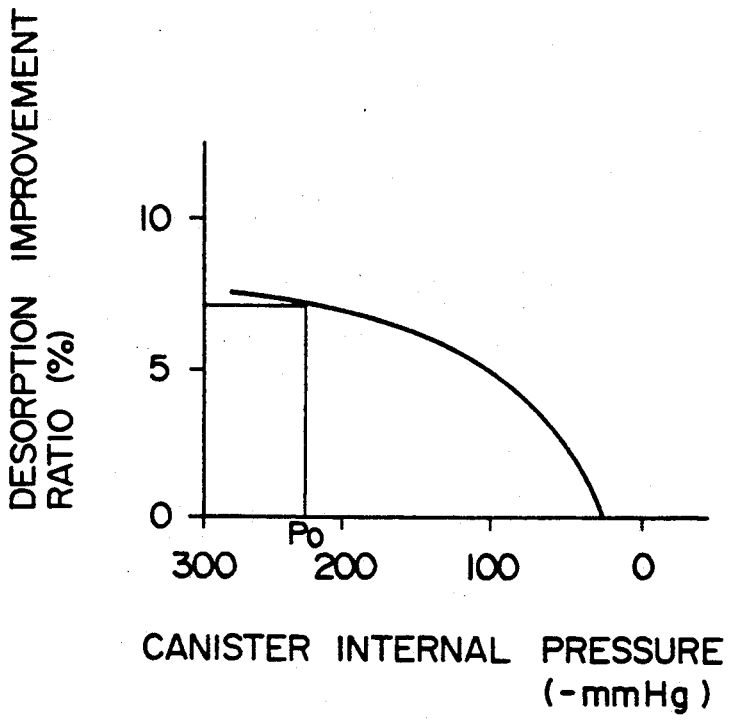
FIG. 5 is a characteristic diagram showing the relationship between the internal pressure of a fuel supplying canister and the improvement ratio of desorption of fuel vapor.

The relationship between the pressure in the fuel supplying canister 2 and the desorption improvement ratio is shown in FIG. 5. In the embodiment, by defining the restriction hole 3*i*, the pressure in the fuel supplying canister 2 can be made to have a value indicated by a reference symbol Po in FIG. 5, that is, about −230 mmHg, and as a result, the desorption improvement ratio of about 7% can be obtained.

According to the present invention, as described above, the atmospheric air port of the canister is fully opened (no restriction), and at times other than fuel supply, a predetermined restriction hole is defined so that the intake pipe negative pressure generated in the internal combustion engine at the time other than fuel supply can be efficiently applied into the canister by virtue of the restriction hole defined in the passage to the atmospheric air port without degrading the fuel supplying efficiency, and as a result, the desorption of the fuel vapor absorbed in the activated carbon during fuel supply is much improved. Further, owing to the improvement of the desorption, the residual fuel vapor in the activated carbon becomes less, and consequently, the lowering or degradation of absorption efficiency (working capacity) of the activated carbon because of aged deterioration can be prevented.

What is claimed is:

1. An apparatus for preventing emission of fuel vapor comprising:

a fuel vapor canister for absorbing fuel vapor generated in a fuel tank during fuel supply and desorbing said absorbed fuel vapor by utilizing an air intake flow of an internal combustion engine;

a tank port having a first end connected to a first side of said fuel vapor canister, a second end of said tank port being connected to the fuel tank;

a purge port having a first end connected to said first side of said fuel vapor canister, a second end of said purge port being connected to an air intake passage of the internal combustion engine;

an atmospheric air port connected to a second side of said fuel vapor canister for introducing air thereto; and switching means for controlling a cross-sectional area of an atmospheric air passage so that said switching means is disposed in a fully opened position during fuel supply, a predetermined restriction hole being defined in the atmospheric air passage at times other than during fuel supply.

2. The apparatus for preventing emission of fuel vapor according to claim 1, wherein switching of said switching means for controlling the cross-sectional area of the atmospheric air passage is carried out by means of energizing a magnetic coil.

3. The apparatus for preventing emission of fuel vapor according to claim 2, wherein said switching means for controlling the cross-sectional area of the atmospheric air passage includes a spring member.

4. The apparatus for preventing emission of fuel vapor according to any one of claims 1, 2 or 3, wherein switching of said switching means for controlling the cross-sectional area of the atmospheric air passage is controlled by means of a controller which is operated by the opening and closing movement of a filler cap.

* * * * *